US005297382A

United States Patent [19]

Waltonen et al.

[11] Patent Number: 5,297,382

[45] Date of Patent: Mar. 29, 1994

[54] INTENSIFIER CYLINDER

[75] Inventors: Edward J. Waltonen, Southfield; Robert E. Obrecht, Bloomfield Hills, both of Mich.

[73] Assignee: REO Hydraulic Pierce & Form, Inc., Detroit, Mich.

[21] Appl. No.: 923,599

[22] Filed: Aug. 3, 1992

[51] Int. Cl.[5] ..... F15B 7/00

[52] U.S. Cl. ..... 60/533; 92/62; 92/107

[58] Field of Search ..... 60/533, 547.1, 560, 60/583; 92/62, 107, 108, 113

[56] References Cited

U.S. PATENT DOCUMENTS

| | | | |
|---|---|---|---|
| 524,184 | 8/1894 | Palmer | 92/107 |
| 3,008,033 | 11/1961 | Senn | 219/89 |
| 3,875,365 | 4/1975 | Beneteau | 219/89 |
| 4,099,436 | 7/1978 | Beneteau | 83/617 |
| 4,153,180 | 5/1979 | Fernique | 60/560 X |
| 4,750,408 | 6/1988 | Stoll | 92/107 X |

FOREIGN PATENT DOCUMENTS

| | | | |
|---|---|---|---|
| 86340 | 8/1894 | Fed. Rep. of Germany | 92/107 |
| 3145401 | 5/1983 | Fed. Rep. of Germany | 60/560 |

OTHER PUBLICATIONS

Bulletin, "OHMA Piercing Cylinder", OHMA[R] Systems Inc. Fraser, Mich.

Bulletin, "Miller Air to Hydraulic Boosters", Miller Fluid Power, Bensenville, IL, Bulletin No. B200-674, 1974.

*Primary Examiner*—Edward K. Look
*Assistant Examiner*—Hoang Nguyen
*Attorney, Agent, or Firm*—Krass & Young

[57] ABSTRACT

An intensifier cylinder including a body structure defining a first bore, a first piston structure including a piston mounted in the first bore and a piston rod secured to the piston and extending at its forward end through an end wall of the body structure, a second bore defined in the body structure, a second piston structure including a second piston mounted in the second bore and a second piston rod secured by the second piston and movable at its forward end into the first bore upon stroking of the second piston in response to the introduction of pressurized gas into the second bore to seal off and act upon hydraulic fluid in the first bore to produce an intensified force on the first piston structure. The first piston structure includes a ram member including an end wall secured to the forward end of the first piston rod and an annular sleeve secured to the ram member end wall and extending rearwardly in surrounding relation to the second piston rod to define an annular space between the first piston rod and the ram sleeve, and the body structure defines an annular bore surrounding the first bore and slidably receiving the annular sleeve of the ram member.

14 Claims, 6 Drawing Sheets

12
24
26
28
26d
26d
24
52
60
28a
52a
92
86
24
30
34
34a
34b
26g
30a
14
26b
26i
44
30c
26c
52j
26h
26e
26a
42
40
26f
26
14
10

14
28
52a
34b
30
62
64
26
60
66
26

50
50a
50g
50b
50i
50c
50i
50a
50f
50e
50h 52
52a
52b
52c
52d
52e
52f
52j
52j
52k
52i 52
52a
52i
52b
50a
50c
52c

INTENSIFIER CYLINDER

BACKGROUND OF THE INVENTION

This invention relates to pressure cylinders and more particularly to pressure cylinders including means to intensify the pressure produced by the cylinders.

Pressure cylinders have been available for many years and have been employed in a multitude of work applications to perform a multitude of work operations such, for example, as piercing, punching, shape forming and resistance welding. In an effort to increase the amount of power or pressure produced by the output member of the pressure cylinder, intensifier systems have been designed for pressure cylinders in which the free end of the piston rod of a pneumatic cylinder acts against the trapped hydraulic fluid in the pressure cylinder to amplify or intensify the power produced by the output member of the pressure cylinder. Pressure cylinders of this type are shown for example in U.S. Pat. Nos. 3,875,365 and 4,099,436.

Whereas these intensifier type pressure cylinders are effective to increase the power output of the cylinder, they continue to embody certain disadvantages inherent in the basic power cylinder design. For example, they require specific anti-rotation means to preclude inadvertent rotation of the piston rod; they are in general unable to handle offset loading of the piston rod because of the limited sliding interface between the piston rod and the bore of the cylinder housing with the result that a complex and expensive guide rod mechanism is necessary to allow offset loading; the rod seal at the interface of the piston rod and the forward end wall of the cylinder experiences heavy loading and as a result requires frequent replacement; the useful life of the rod seal is further limited by debris that is introduced into the seal by the reciprocal movement of the piston rod; in situations where the piston rod is used to raise a load, the raised load must be propped up by auxiliary support means since the surface area of the piston rod is inadequate to provide a stable support platform for the raised load; and, in situations requiring a large tool mounting area on the free end of the piston, a separate mounting platform must be positioned on the free end of the piston.

SUMMARY OF THE INVENTION

This invention is directed to the provision of an improved intensifier cylinder.

This invention is further directed to the provision of an improved power cylinder construction for use in an intensifier cylinder and to an improved piston assembly for use in an intensifier cylinder.

The invention intensifier cylinder is of the type including a body structure defining a first bore; means for introducing liquid into the first bore; a first piston structure including a piston mounted in the first bore and a piston rod secured to the first piston and extending at its forward end through an end wall of the body structure; a second bore defined in the body structure; and means for introducing pressurized fluid into the second bore; a second piston structure including a second piston mounted in the second bore and a second piston rod secured to the second piston and movable at its forward end into the first bore upon stroking of the second piston in response to the introduction of pressurized fluid into the second bore to seal off and act upon the liquid in the first bore to produce an intensified force on the first piston structure.

According to the invention, the first piston structure further includes a ram member including an end wall secured to the forward end of the first piston rod and an annular sleeve secured to the ram member end wall and extending rearwardly in surrounding relation to the second piston rod, and the cylinder body structure defines an annular bore surrounding the first bore and slidably receiving the sleeve of the ram member. This arrangement provides a large area interface as between the first piston structure and the cylinder body so as to allow offset loading on the piston structure, minimizes loading on the rod seal of the piston rod of the first piston structure, precludes the entry of contaminants into the rod seal to prolong rod seal life, and eliminates the need to separately prop loads that have been raised by the pressure cylinder.

According to a further feature of the invention, the first bore, the annular bore, the ram member end wall, and the sleeve all have a rectangular cross-sectional configuration. This arrangement eliminates the need for a separate anti-rotation provision with respect to the first piston structure.

According to a further feature of the invention, an annular space is defined between the first piston rod and the sleeve and the first piston structure includes means for introducing hydraulic fluid into the annular space upon forward movement of the first piston structure. This arrangement allows hydraulic fluid to fill in behind the end wall of the ram member and fill the annular space between the sleeve of the ram member and the second piston rod as the first piston structure is moved forwardly to a ready position in preparation for the final high pressure working stroke, whereby to increase the are of the first piston exposed to hydraulic fluid, thereby increase the ratio of the first piston area exposed to hydraulic fluid to the cross-sectional area of the second piston, and thereby further intensify the force produced at the free end of the ram member.

In the disclosed embodiment of the invention, the means for introducing hydraulic fluid into the annular space includes a central bore in the first piston rod opening in the rear face of the first piston rod and radial bore means proximate the juncture of the forward end of the first piston rod and the end wall of the ram member extending between the central bore and the annular space.

According to a further feature of the invention, the body structure includes an axially extending sleeve, the body structure end wall through which the first piston rod extends is constituted by a front end wall of the body structure sleeve, the first bore is defined by the inner periphery of the body structure sleeve, and the inner periphery of the annular bore is defined by the outer periphery of the body structure sleeve. This arrangement allows a simple sleeve construction to be utilized to define the bore of the first piston structure as well as a portion of the annular guide bore receiving the sleeve of the ram member.

According to a further feature of the invention the intensified cylinder further includes passage means extending axially in the body structure sleeve and opening in the interior of the body structure sleeve proximate the front end wall of the body structure sleeve. This arrangement allows hydraulic fluid to be supplied to the front face of the first piston to facilitate the return of the pressure cylinder to its rest position following the completion of a work operation.

The invention further provides an improved power cylinder construction including a cylinder body defining a central bore and an annular bore surrounding the central bore, and a piston assembly including a piston mounted in the central bore, a piston rod rigid with the piston and extending forwardly for passage at its front end through an end wall of the cylinder body, an end wall rigid with the free end of the piston rod, and an annular sleeve rigid with the end wall and extending rearwardly therefrom in surrounding relation to the piston rod and slidably received in the annular bore.

The invention further provides an improved piston assembly including a piston member, including a piston and a reduced diameter piston rod extending forwardly from the piston, and a ram member including a front end wall rigid with the front end of the piston rod and a sleeve extending rearwardly from the front end wall in surrounding relation to the piston rod and forming an annular space with the piston rod.

DETAILED DESCRIPTION OF THE PREFERRED EMBODIMENT

Figure 1:
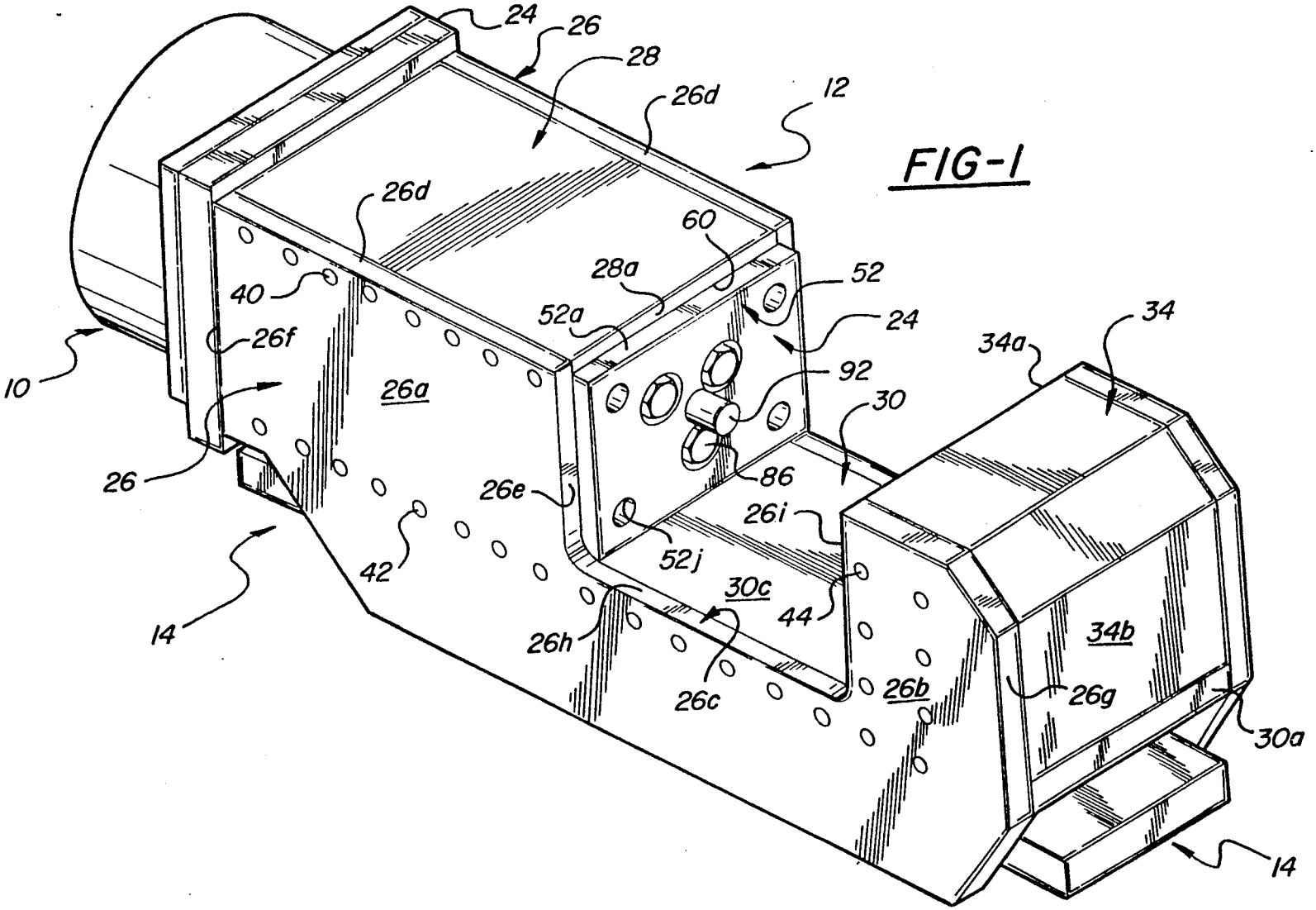
FIG. 1 is a perspective view of an intensifier cylinder according to the invention.
Figure 2:
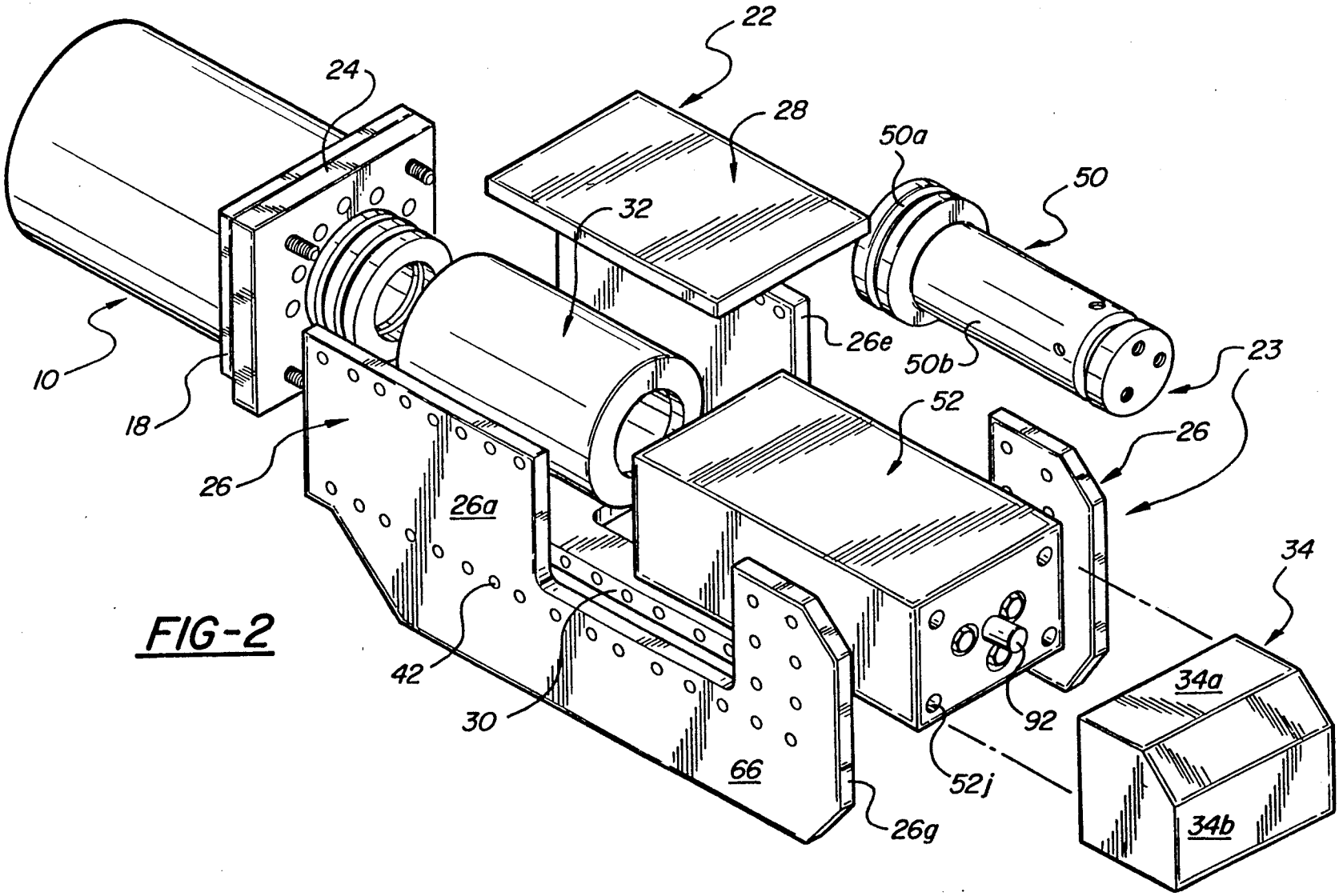
FIG. 2 is an exploded view of the invention intensifier cylinder.

The invention intensifier cylinder, broadly considered, includes an air cylinder assembly 10, a hydraulic cylinder assembly 12, and a base assembly 14.

Air cylinder assembly 10 is secured to hydraulic cylinder assembly 12 to form the total pressure cylinder assembly and the total pressure cylinder assembly is slidably mounted on base assembly 14.

Air cylinder assembly 10 is of known form and includes a cylinder body 16 defining a circular bore 16*a*, a flange plate 18 of rectangular configuration secured to the front annular edge of cylinder body 16, and a piston member 20.

Piston member 20 includes a piston 20*a* of circular cross section slidably mounted in bore 16*a* and a piston rod 20*b* rigid with piston 20*a* and extending forwardly therefrom for passage at its forward end 20*c* through an opening 18*a* in flange plate 18.

Hydraulic cylinder assembly 12 includes a cylinder body assembly 22 and a piston assembly 23.

Cylinder body assembly 22 includes a rear end plate 24, side plates 26, a top plate 28, a bottom plate 30, a sleeve 32, and an anvil 34.

Rear end plate 24 includes a rectangular main body portion 24*a* and a circular hub portion 24*b* extending forwardly from the front face 24*c* of main body portion 24*a*. Circular hub portion 24*b* includes seal grooves 24*d* and 24*e*. A central bore 24*f* extends through the end plate concentric with the central axis of hub portion 24*b* and includes a rear portion 24*g* and a forward portion 24*h*. A counterbore 24*i* is provided in the rear face 24*j* of main body portion 24*a* and a further counterbore 24*k* extends between bore portions 24*g* and 24*h* with a chamfered or biased bore portion 24*l* interconnecting counterbore 24*k* and forward bore portion 24*h*. A transverse or radial bore 24*m* opens in counterbore 24*k* and a transverse counterbore 24*n* communicates with transverse bore 24*m* to provide passage means extending from counterbore 24*k* to the side face 24*p* of the end plate. A further transverse or radial bore 24*q* is positioned beneath bore 24*m* and communicates at its outboard end with a counterbore 24*r* opening in end plate side face 24*p*. The inboard end of bore 24*q* communicates with a central axial bore 24*s* which in turn communicates at its forward end with a radially outwardly extending bore 24*t* opening in the peripheral surface of hub portion 24*b* between seal grooves 24*d* and 24*e*. Internal seal grooves 24*u* and 24*v* are provided respectively in central bore portions 24*g* and 24*h*.

The two side plates 26 are identical and each includes a main body portion 26*a*, a distal or front end portion 26*b*, and a cut-out 26*c*.

Top plate 28 has a rectangular configuration and is fixedly secured between the upper edges 26*d* of the main body portions of side plates 26 by a plurality of bolts 40. Further bolts, not shown, pass through rear end plate 24 for threaded engagement with the rear edge of top plate 28 and the rear edges 26*f* of the side plates 26. Top plate 28 has a length corresponding to the length of main body portion 28*a* of the side plates so that the forward edge 22*a* of the top plate is flush with the vertical edges 26*e* of the side plates defining the rear border of cut-outs 26*c* and the rear edge 28*b* of the top plate is flush with the rear edges 26*f* of the side plates.

Bottom plate 30 has a rectangular configuration and is positioned between side plates 26, in spaced underlying relation to top plate 22, by bolts 42 with the forward edge 30*a* of the bottom plate flush with the forward edge 26*g* of the side plates, the rear edge 30*b* of the bottom plate flush with the rear edges 26*f* of the side plates, and the top face 30*c* of the bottom plate flush with the horizontal edges 26*h* of the side plate cut-outs 26*c*. Further bolts, not shown, pass through rear end plate 24 for threaded engagement with the rear edge 30*b* of the bottom plate.

Sleeve 32 has a circular configuration sized to fit over hub portion 24*b* of rear end plate 24 and includes a main body cylindrical portion 32*a* defining a central bore 32*b* and a front end wall 32*c* defining an opening 32*d* and including an inner annular seal groove 32*e* and an outer annular seal groove 32*f*. An axial passage 32*g* in cylindrical portion 32*a* communicates with bore 32*b* at its rearward end through a radial port 32*h* and communicates with bore 32*b* at its forward end through a radial port 32*i*.

Anvil 34 is positioned between the distal ends 26*b* of side plates 26 by bolts 44 with the rear face 34*a* of the anvil flush with the front edges 26*i* of the cut-outs 26*c* and the forward face 34*b* of the anvil flush with the forward edges 26*g* of the side plates 26 and the forward edge 30*a* of the bottom plate 30.

Piston assembly 23 includes a piston member 50 and a ram member 52.

Piston member 50 includes a piston 50 of circular cross section sized to be slidably mounted in sleeve bore 32*b* and a piston rod 50*b* of circular cross section sized to pass slidably through opening 32*d* in end wall 32*c* of sleeve 32. A central bore 50*c* opens at its rear end in the rear face 50*d* of the piston and terminates at its forward end short of the front end face 50*e* of the piston rod to define a front end wall portion 50*f* of the piston rod. A seal groove 50*g* is provided in piston 50*a*; a seal groove 50*h* is provided in piston rod end wall 50*f*; and a plurality of circumferentially spaced radial ports 50*i* extend between bore 50*c* and the exterior of the piston rod proximate the rear face of end wall portion 50*f*.

Ram member 52 has a rectangular cross-sectional configuration and is sized to fit slidably within the rectangular bore 60 defined between top plate 28, side plates 26, and bottom plate 30 of the cylinder body assembly.

Ram member 52 includes a front end wall portion 52*a* of rectangular configuration and a sleeve portion 52*b* of rectangular configuration extending rearwardly from end wall portion 52*a*. The inner periphery 52*c* of sleeve9 portion 52*b* has a circular configuration corresponding generally to the configuration of the external periphery of sleeve 32. A central blind bore 52*d* is provided in end wall portion 52*a* and opens in the rear face 52*e* of the end wall portion, and a shallow depression or counterbore 52*f* is provided in the rear face 52*e* of the end wall portion 52*a* in concentric surrounding relation to bore 52*d*.

Base assembly 14 includes a base plate 60, a pair of elongated ways 62 secured to the upper face of the base plate, and a pair of linear roller bearings 64 interposed between respective ways 62 and ways 66 secured to the underface of base plate 30. Linear roller bearings 64 include small cylindrical rollers mounted in cages rollably engaging elongated ways 62, 64. The rollers are of equal axial length and diameter and are mounted in the cages such that every other roller is placed in an opposite bearing support orientation.

In the assembled relation of the intensifier cylinder, air cylinder assembly 10 is bolted to the rear face of end plate 24 by bolts 80; sleeve 32 is bolted to the front face 24*c* of end plate 24 in surrounding, sealing relation to hub portion 24*b* by bolts 82 with hub portion bore 24*t* aligned with sleeve port 32*h*; side plates 26, top plate 28, and bottom plate 30 are bolted at their rear edges to the front face 24*c* of end plate 24 in surrounding relation to sleeve 32 with the inner peripheral surfaces of the plates coacting with the outer periphery of the sleeve to define an annular bore 85 between the plates and the sleeve with a rectangular outer periphery and a circular inner periphery and corresponding generally in cross-sectional configuration to the cross-sectional configuration of the sleeve portion 52*b* of ram member 52; piston 50*a* of piston member 50 is slidably received in the bore 32*b* of sleeve 32 with piston rod 50*b* passing sealingly through opening 32*d* in end wall 32*c* of sleeve 32; end wall 50*e* of piston 50 is positioned within blind bore 52*d* in the end wall 52*a* of ram member 52 with bolts 86 passing through end wall 52*a* for threaded engagement with tapped bores in piston end wall 50*e*; sleeve portion 52*b* of ram member 52 is slidably received in the annular bore 85 defined between the inner periphery of the plates 26, 28 and 30 and the outer periphery of sleeve 32; and the entire cylinder assembly is mounted for sliding movement on base assembly 10 by linear roller bearings 64 coacting with ways 62, 66.

Figure 3:
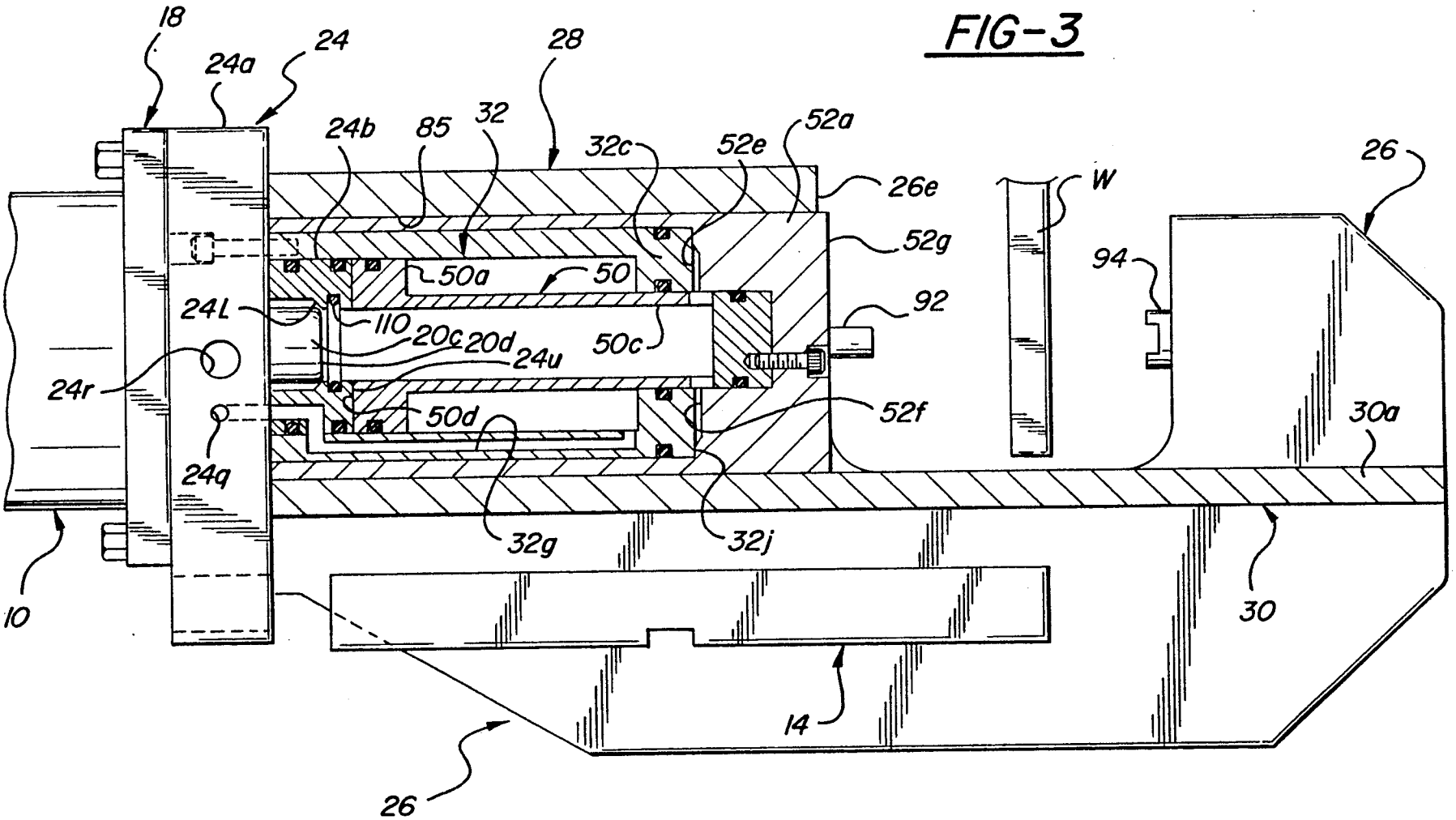
FIG. 3 is a longitudinal cross-sectional view of the invention intensifier cylinder in a retracted or rest position.

With the cylinder in its retracted or rest position as seen in FIG. 3, the forward end 20*c* of air cylinder piston rod 20 passes slidably and sealingly through rear bore portion 24*g* in end plate 24 with the forward tip 20*d* of the piston rod positioned proximate chamfered bore portion 24*l* to define an annular passage 90 between bore portion 24*l* and the forward end of the piston rod; the rear face 50*d* of piston 50*a* of piston member 50 is positioned against the front face 24*u* of the hub portion 24*b* of end plate 24; the rear face 52*e* of the end wall portion 52*a* of ram member 52 is positioned against the forward face 32*j* of the end wall portion 32*c* of the sleeve 32 so that the front face 52*g* of the ram member is positioned proximate the vertical edges 26*e* of cut-outs 26*c* to allow a workpiece W to be positioned within the cut-outs 26*c* so as to allow suitable coacting tooling, such a punch 92 secured to the front face of the ram and a die 94 secured to the rear face of the anvil, to act in a coacting manner on the workpiece W positioned within the cut-outs 26*c*; and hydraulic fluid fills the bore 50*c* of piston member 50*j*, radial ports 50*i*, recess 52*f*, bore 24*h*, and the annular space surrounding piston rod forward end portion 20*c*.

Figure 4:
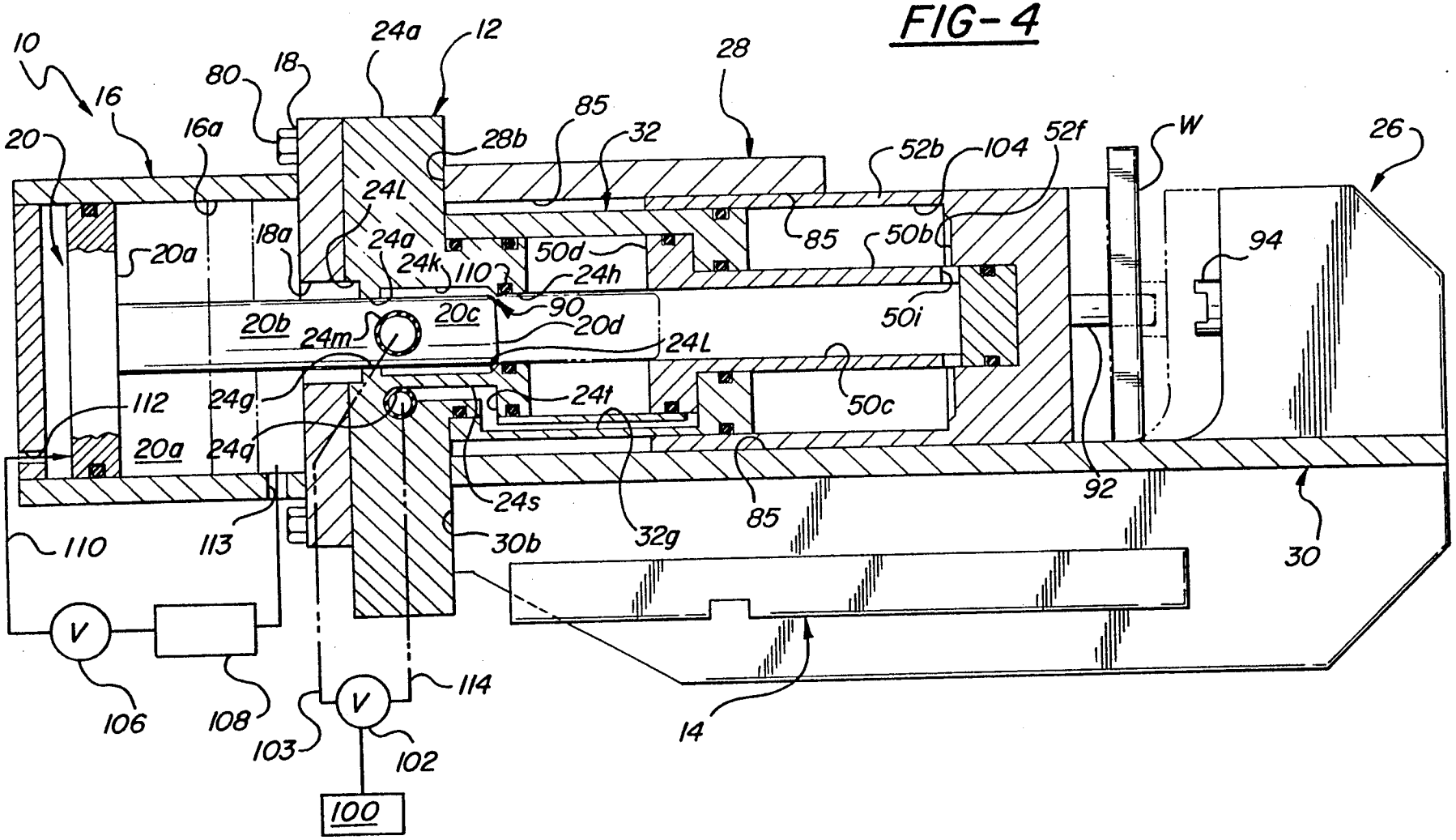
FIG. 4 is a longitudinal cross-sectional view showing the cylinder in an expanded or ready condition.
Figures 5, 6, 7, 8, 9:
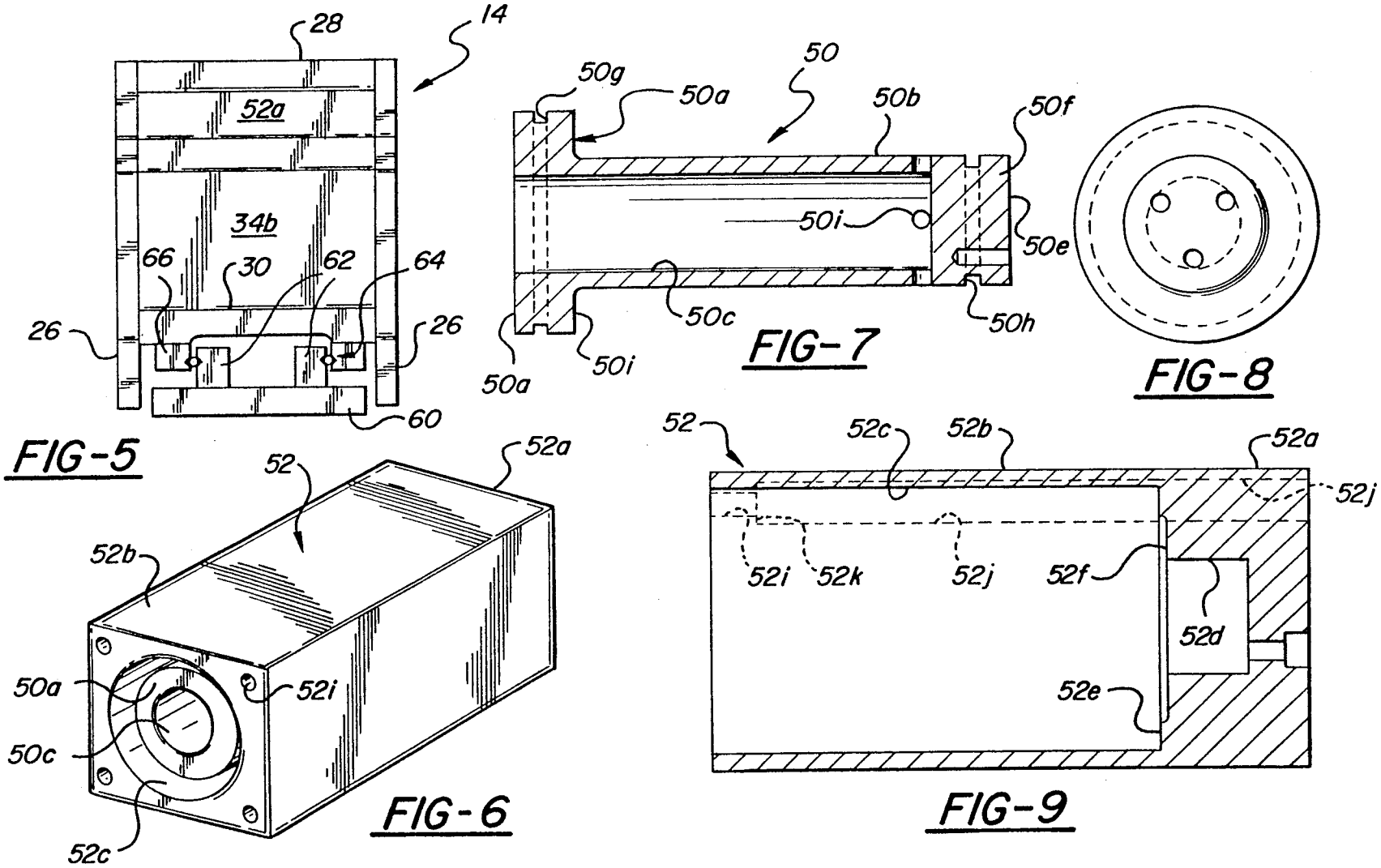
FIG. 5 is an end view of the invention cylinder.
FIG. 6 is a perspective view of a piston assembly employed in the invention cylinder.
FIG. 7 is a cross-sectional view of the piston member of the piston assembly.
FIG. 8 is an end view of the piston member.
FIG. 9 is a cross-sectional view of a ram member employed in the invention piston assembly.
Figure 11:
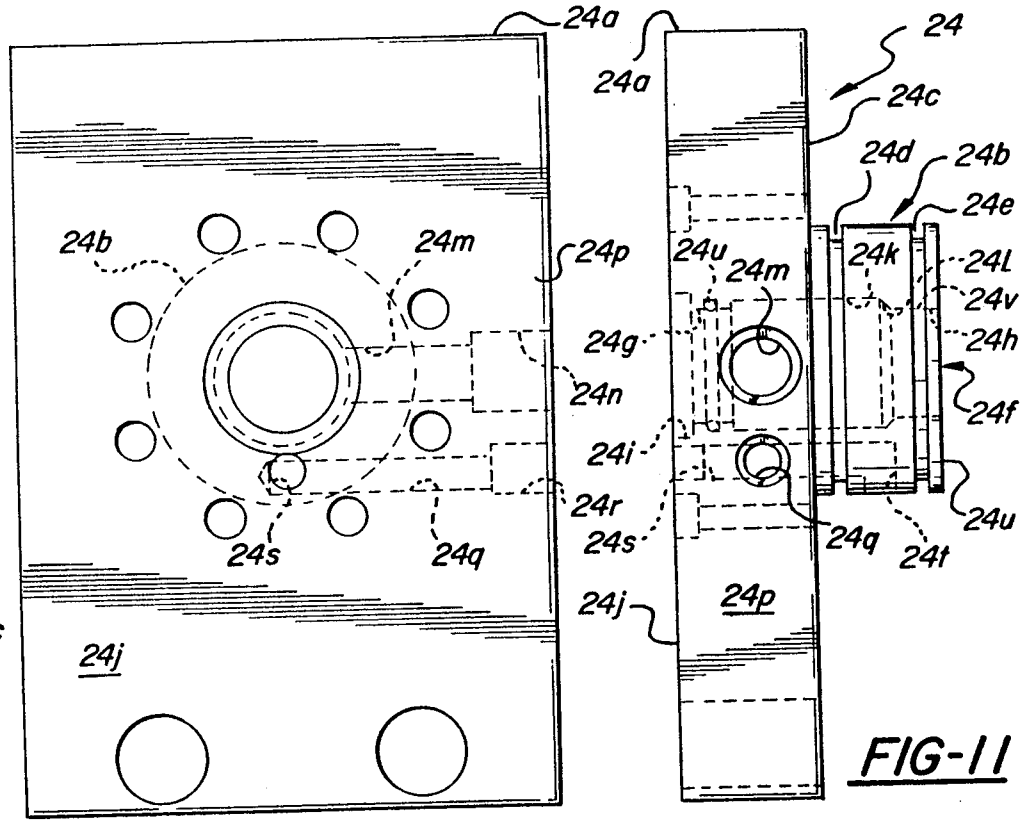
FIGS. 11 and 12 are side and end views respectively of an end plate employed in the invention cylinder.
Figure 12:
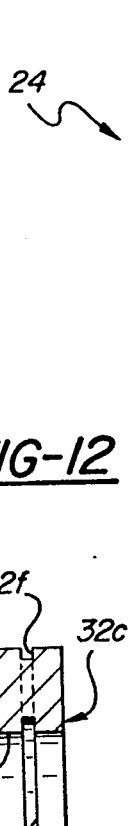
Figure 14:
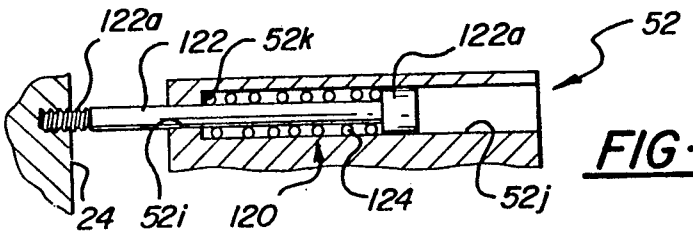
FIG. 14 is a fragmentary view showing a spring assisted return mechanism utilized in the invention intensifier cylinder.
Figure 10:
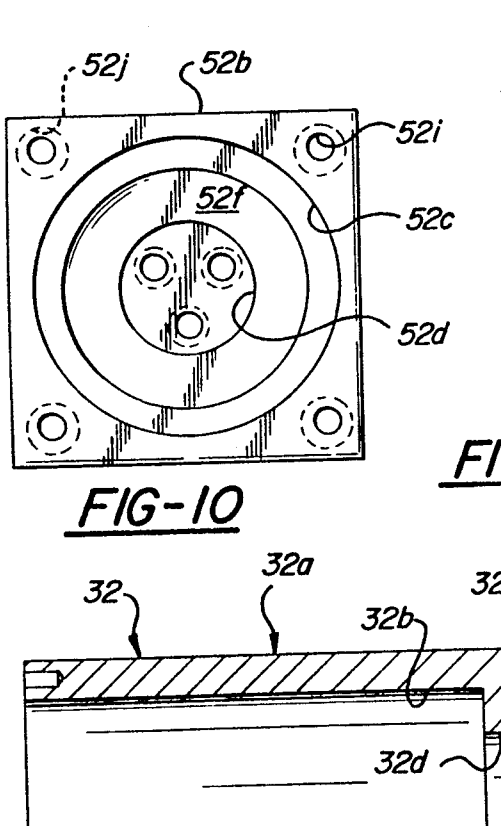
FIG. 10 is an end view of the ram member.
Figure 13:
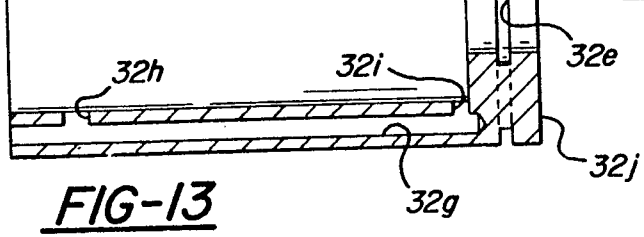
FIG. 13 is a longitudinal cross-sectional view of a sleeve employed in the invention cylinder.

In order to move the cylinder to a ready position preparatory to a work operation, further hydraulic fluid under low pressure from a source of hydraulic fluid 100 is supplied through a valve 102 and a conduit 103 to bores 24*n* and 24*m* and thence into the annular space between the piston rod portion 20*c* and the counterbore 24*b* from where it flows forwardly through annular space 90 to move the ram member to the ready position shown in solid lines in FIG. 4 with the hydraulic fluid filling in behind the advancing piston member and also filling in behind the advancing ram member as hydraulic fluid flows through radial ports 50*i* into recess 52*f*, and thence into and filling the annular cavity 104 created between the piston rod 50*b* and the ram sleeve 52*b* as the ram moves forwardly to its ready position.

The cylinder assembly is preferably mounted on the base assembly 14 in a self-equalizing manner so that as the ram is moved forwardly to its ready position the cylinder body moves in a counter direction to move the die 94 carried by anvil 34 from the solid line position of FIG. 4 to the dotted line position of FIG. 4 where it acts against the front face of the workpiece W to counterbalance or equalize the force being exerted against the workpiece W by the punch 92 acting against the rear face of the workpiece. The manner in which the cylinder assembly is mounted on the base assembly to provide this self-equalizing movement so as to support both the front and rear faces of the workpiece is well known and is shown for example in applicant's U.S. Pat. Nos. 4,716,803 and 4,763,550. Although the cylinder assembly is shown operating in a self-equalizing manner, it will be understood that the cylinder is also capable of operating equally well in a non-self-equalizing environment.

After the ram has been moved to its ready position (seen in solid lines in FIG. 4) by the hydraulic fluid, a valve 106 is opened to deliver pressurized air from a source of pressurized air 108 through a line 110 to a port 112 in air cylinder 10 while exhausting air through a port 113 so as to admit pressurized air behind the piston 20*a* and move the piston member 20 forwardly within the cylinder bore 16*a*.

As the piston member moves forwardly in the bore 16*a*, the forward tip 20*d* of the piston rod 20*b* moves forwardly to initially seal off the hydraulic fluid in the cylinder as it moves forwardly through bore 24*h* in coaction with a lip seal 110 in seal groove 24*v*, whereafter the front end 20*d* of the piston rod continues forwardly until it is positioned just forwardly of the rear face 50*d* of the piston 50*a* within the central bore 50*c*. As the piston rod of the air cylinder moves forwardly to its dotted line position of FIG. 4, the ram is moved forwardly by a small amount (to the dotted line position of FIG. 4) sufficient to accomplish the work operation, such for example as punching a hole in the workpiece W. This slight forward movement of the ram is under intensified pressure so as to facilitate performance of the work operation on the workpiece W.

The amount of intensification will of course be chosen depending upon the work operation to be performed and the available shop air pressure. For example, the air cylinder 10 may have an inner diameter or bore 16*a* of 6 inches and a 5 inch stroke; air cylinder piston rod 20*b* may have a diameter of 1⅜"; sleeve central bore 32*b* may have a diameter of 3½"; piston rod 50*b* may have an outer diameter of 2" and an inner diameter of 1½"; ram 52 may have an inner diameter of 4½"; the available shop air may be 100 psi so as to produce a force of 28,274 lbs. on the 28.274 square inch area of piston 20*a*; the piston assembly 24 moves forwardly through an approximately 4 inch stroke as it moves from its rest position to its ready position; and the piston assembly 24 moves through 0.34 inches during the final intensified working stroke as the piston rod 20*b* moves through its 5 inch stroke.

It will be seen that hydraulic fluid acts on the piston assembly 23 over an area equal to the combined area of the piston 50*a* plus the annular area defined between the outer periphery of piston rod 50*b* and the inner periphery of ram 52. For the cylinder dimensions given, this area equals 21.632 inches. The intensifier factor provided by the invention intensifier cylinder is equal to the ratio of the area on which the hydraulic fluid is acting on the piston assembly 24 to the cross-sectional are of piston rod 20*b* or 21.672 square inches divided by 1.47 square inches or approximately 14.7. Accordingly, the 28,274 lbs. exerted on the piston 20*a* by the shop air is converted during the final intensifier stroke to approximately 21,562 lbs. of force on the piston assembly 23. It will thus be seen that the unique design of the invention intensifier cylinder, whereby the area against which the hydraulic fluid acts against the piston assembly 23 is equal to the sum of the area of the piston 50*a* and the annular area defined between the piston rod 50*b* and the sleeve and ram member 52, acts to provide an intensifier effect that far exceeds the effect achieved with prior art intensifier designs which lack the ram member 52.

In order to return the cylinder to its rest position following the work operation, valve 102 is actuated in a sense to direct hydraulic fluid from source 100 through a line 114 to ports 24*r* and 24*q* whereafter it flows through passages 24*s*, 24*t*, 32*h*, 32*g* and 32*i* to enable it to act against the front annular face 50*i* of the piston 50*a* and thereby move the piston assembly, including the ram member 52, back to its rest position as seen in FIG. 3 with the hydraulic fluid exiting through the annular space 90, the annular space between the bore 24*b* and the piston rod portion 20*c*, bores 24*m* and 24*n*, and line 103 for return through valve 102 to source 100. In some situations, particularly where the apparatus is operating in a vertical position against gravity, it may be desirable to augment the return action of the hydraulic fluid by the use of return spring assemblies 120. Each spring assembly 120 includes a bolt 122 threadably received at its rear end 122*a* in a threaded bore in end plate 24 and extending forwardly for passage through a bore 52*i* in a corner portion of ram 52 to position the bolt head 122*a* in a counterbore 52*j* in the ram, and a coil spring 124 positioned around the bolt between the bolt head and the shoulder 52*k* formed between the bore 52*i* and the counterbore 52*j*.

It will be apparent that as the ram moves forwardly to its ready position, springs 124 are compressed to store energy to assist the return movement of the ram to its rest position.

The invention intensified cylinder will be seen to provide a greatly increased intensifier effect as compared to prior art intensifier cylinders and will further be seen to provide the intensifier function with a structure that is simple and efficient; that precludes the necessity for any separate anti-rotation means; that allows off-center loading of the output piston, thereby eliminating the need for separate guide mechanisms to facilitate off-center loading; that substantially increases piston rod seal life by removing the loading from the rod seal and by eliminating the entry of contaminants into the area of the rod seal; and that provides a large area surface at the free end of the output piston, thereby eliminating the need for auxiliary proping of raised loads or the need to provide a separate mounting platform to augment the tool mounting area of the piston.

Whereas a preferred embodiment of the invention has been illustrated and described in detail, it will be apparent that various changes may be made in the disclosed embodiment without departing from the scope or spirit of the invention.

We claim:

1. An intensifier cylinder including a body structure defining a first bore, means for introducing hydraulic fluid into said first bore, a first piston structure including a piston mounted in said first bore and a piston rod secured to said piston and extending at its forward end through an end wall of said body structure, a second bore defined in said body structure, means for introducing pressurized fluid into said second bore, a second piston structure including a second piston mounted in said second bore and a second piston rod secured to said second piston and movable at its forward end into said first bore upon stroking of said second piston in response to the introduction of pressurized fluid into said second bore to seal off and act upon the hydraulic fluid in said first bore to produce an intensified force on said first piston structure; characterized in that said first piston structure further includes a ram member including an end wall secured to the forward end of said first piston rod and an annular sleeve secured to said ram member end wall and extending rearwardly in surrounding relation to said first piston rod, said body structure defines an annular bore surrounding said first bore and slidably receiving said sleeve, an annular space is defined between said first piston rod and said sleeve, and said first piston structure includes means for introducing hydraulic fluid into said annular space upon forward movement of said first piston structure.

2. A cylinder according to claim 1 wherein said first bore, said annular bore, said ram member end wall, and said sleeve having a rectangular cross-sectional configuration.

3. A cylinder according to claim 1 wherein said introducing means includes a central bore in said first piston rod opening in the rear face of said first piston and radial bore means extending between said central bore and said annular space.

4. A cylinder according to claim 3 wherein said radial bore means are proximate the juncture of the forward end of said first piston rod and said ram member end wall.

5. A cylinder according to claim 1 wherein said body structure includes an axially extending sleeve, said body structure end wall is constituted by a front end wall of said body structure sleeve, said first bore is defined by the inner periphery of said body structure sleeve, and the inner periphery of said annular bore is defined by the outer periphery of said body structure sleeve.

6. A cylinder according to claim 5 wherein said cylinder further includes passage means extending axially in said body structure sleeve and opening in the interior of said body structure sleeve proximate the front end wall of said body structure sleeve.

7. A power cylinder construction including:

a cylinder body defining a central bore and an annular bore surrounding said central bore; and a piston assembly including a piston mounted in said central bore, a piston rod rigid with said piston and extending forwardly for passage at its forward end through an end wall of said cylinder body, an end wall rigid with the forward end of said piston rod, and an annular sleeve rigid with said end wall and extending rearwardly therefrom in surrounding relation to said piston rod and slidably received in said annular bore;

said sleeve having a rectangular cross sectional configuration at its outer periphery and said annular bore having a matching rectangular cross sectional configuration at its outer periphery; and said sleeve having a circular cross sectional configuration at its inner periphery and said annular bore having a matching circular cross sectional configuration at its inner periphery.

8. A cylinder construction according to claim 7 wherein said piston and said central bore have matching circular cross-sectional configurations.

9. A cylinder construction according to claim 7 wherein said cylinder construction further includes passage means extending between the rear face of said piston and the annular space between said piston rod and said sleeve.

10. A cylinder construction according to claim 9 wherein said passage means comprise an axial bore in said piston rod opening in the rear face of said piston and radial passage means extending between said axial bore and said annular space.

11. A cylinder construction according to claim 10 wherein said radial passage means are proximate the juncture of said piston rod and said end wall.

12. A cylinder construction according to claim 7 wherein said cylinder body includes an axially extending sleeve, said end wall is constituted by a front end wall of said sleeve, the inner periphery of said sleeve defines said central bore, and the outer periphery of said sleeve defines the inner periphery of said annular bore.

13. A cylinder construction according to claim 12 wherein said cylinder construction further includes passage means extending axially in said sleeve and opening in the interior of said sleeve proximate the front end wall of said sleeve.

14. A piston assembly including a piston and a reduced diameter piston rod extending forwardly from said piston, and a ram member including a front end wall rigid with the front end of sad piston rod and a sleeve extending rearwardly from said front end wall in surrounding relation to said piston rod and forming an annular space with said piston rod;

characterized in that the exterior periphery of said sleeve has a rectangular cross-sectional configuration, the inner peripheral surface of said sleeve has a circular cross-sectional configuration, and the outer peripheral surface of said piston has a circular cross-sectional configuration having a diameter less than the diameter of the inner peripheral surface of the sleeve and concentric with the inner peripheral surface of the sleeve so as to define a circular annular space between the inner peripheral surface of the sleeve and the outer peripheral surface of the piston of uniform radial thickness.

* * * * *